United States Patent [19]

Kramer et al.

[11] 4,367,644

[45] Jan. 11, 1983

[54] ADJUSTABLE DIE AND KEY ASSEMBLY

[75] Inventors: Fred Kramer, Downingtown, Pa.; Gregg Gill, Cuyahoga Falls, Ohio

[73] Assignee: Pennsylvania Crusher Corporation, Allentown, Pa.

[21] Appl. No.: 194,101

[22] Filed: Oct. 6, 1980

[51] Int. Cl.[3] ..... B21D 5/02

[52] U.S. Cl. ..... 72/389; 72/448

[58] Field of Search ..... 72/389, 386, 380, 446, 72/447, 448

[56] References Cited

U.S. PATENT DOCUMENTS

| | | | |
|---|---|---|---|
| 784,725 | 3/1905 | Yates | 72/389 |
| 2,451,302 | 10/1948 | Peters | 153/38 |
| 2,748,829 | 6/1956 | Korenak | 72/389 |
| 2,765,836 | 10/1956 | Niekelski | 72/389 |
| 2,860,684 | 11/1958 | Palouian | 153/2 |
| 3,456,481 | 7/1969 | Zeitlin | 72/446 |
| 3,559,522 | 2/1971 | Valante | 83/571 |
| 3,675,463 | 7/1972 | Munschauer | 72/389 |
| 3,812,703 | 5/1974 | Tepper | 72/326 |
| 3,881,343 | 5/1975 | Ducate | 72/455 |
| 3,996,777 | 12/1976 | Ekberg | 72/36 |
| 4,106,323 | 8/1978 | Haenni et al. | 72/389 |
| 4,301,673 | 11/1981 | Yonezawa | 72/448 |

FOREIGN PATENT DOCUMENTS

| | | | |
|---|---|---|---|
| 1496270 | 9/1967 | France | 72/448 |
| 52-19850 | 2/1977 | Japan | 72/446 |

*Primary Examiner*—Gene Crosby

*Attorney, Agent, or Firm*—Pollock, Vande Sande and Priddy

[57] ABSTRACT

An assembly for precisely positioning a pair of die members beneath a reciprocating press ram, wherein a clamping assembly extends between each die member and a frame supported on a bed of the press for clamping and unclamping the die members. A self-lifting assembly provides a force which bears downwardly against the frame and upwardly against the die members for appreciably reducing frictional contact therebetween. An adjustable key is positioned for aligning the frame beneath the reciprocating ram. Finally, positioning apertures are provided for aligning the die members relative to one another on the frame.

19 Claims, 11 Drawing Figures

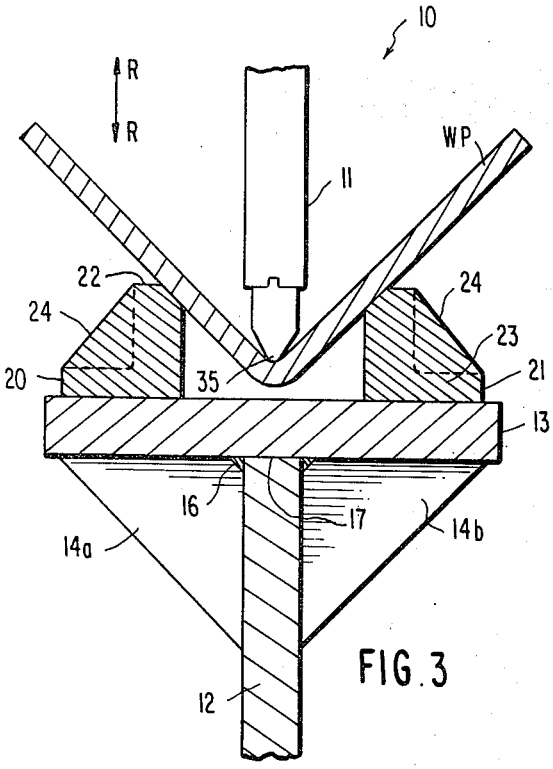
FIG. 3
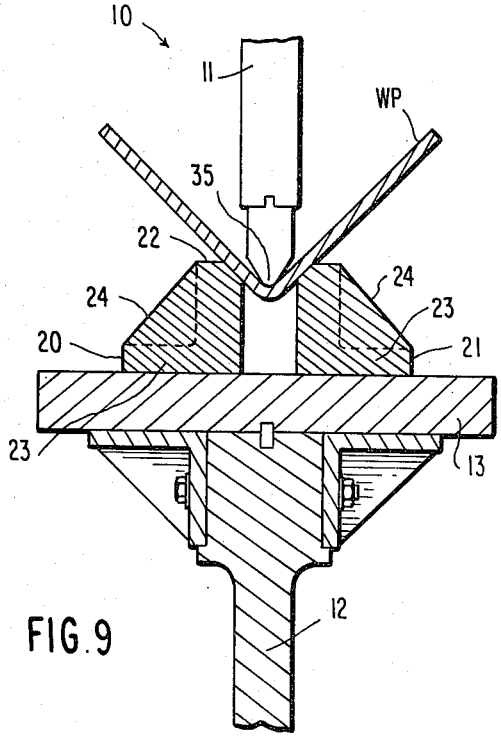
FIG. 9
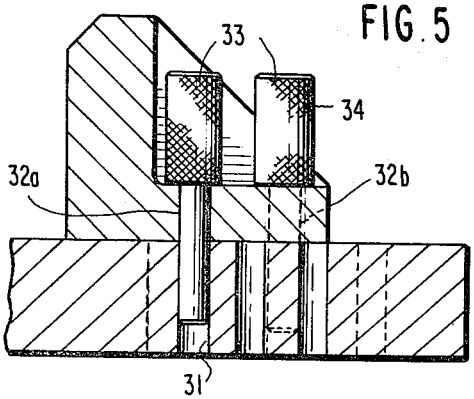
FIG. 5
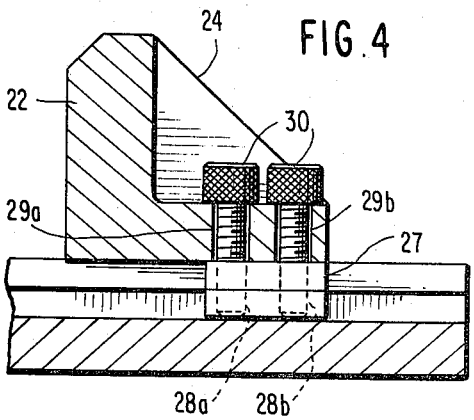
FIG. 4
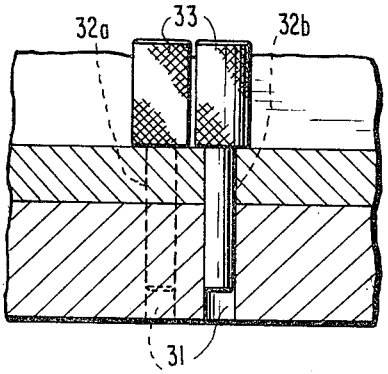
FIG. 7
FIG. 6
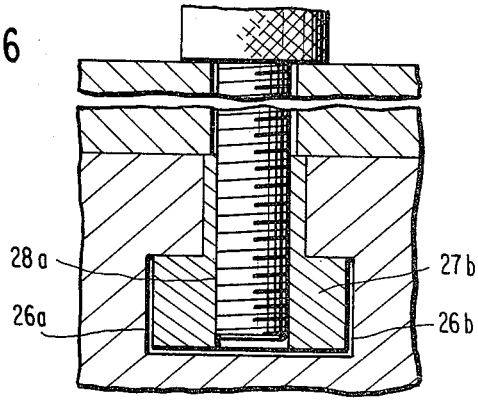

ADJUSTABLE DIE AND KEY ASSEMBLY

TECHNICAL FIELD

The present invention relates to adjustably positionable die members for use in a press machine assembly capable of bending a workpiece formed of steel plate or the like.

BACKGROUND

The present invention generally relates to presses capable of bending plate material or the like. In particular, the present invention is directed to a rugged and dependable adjustable die assembly including a pair of die members capable of being easily, quickly and accurately positioned relative to one another to allow for selective bending of a workpiece at a variety of predetermined angles and/or radii.

Large capacity hydraulic or mechanical presses e.g. of about 500 tons and larger capacity, have suffered from long standing problems preventing quick and accurate adjustment of the die members relative to one another. Because components of the forces generated in such large capacity machine assemblies during the bending of relatively thick steel plate must pass directly through the die members, it has long been considered necessary to employ die members having considerable mass. However, the very mass necessary for withstanding such forces makes it exceedingly difficult to move the die members relative to one another when adjusting the gap between the die members for changing the angle of bend to be formed in the workpiece. Moreover, certain of the temporary fastening or positioning means for the dies which are sufficiently rugged to withstand the aforementioned forces suffer from limitations in respect to versatility and ease of adjustment, while other more versatile and readily adjustable fastening or positioning means suffer from disadvantages of complexity, costliness and inadequate ruggedness. Moreover, if the dies are mounted in a frame which is not integral with the press bed and secured to a keyway therein, difficulties have been encountered in effecting proper alignment of the frame with the bed and consequently with the ram of the press.

A known arrangement providing considerable ruggedness and accurate die positioning involves bolting the dies to the inner surfaces of upright sides of an open-top (often also open-ended) rigid box or cage. To adjust the die spacing, the dies are unbolted, shims of predetermined thickness are inserted between their back sides and the sides of the box or cage and the dies and shims are then bolted into the box. However, a relatively large number of pairs of shims of various sizes must be employed to provide a wide variety of required bending angles. Because each pair of shims is relatively expensive and must be stored when not in use, this arrangement suffers from disadvantages of cost and storage requirements. More importantly, shims employed in heavy duty press brake assemblies can themselves be exceedingly heavy and cumbersome, often requiring two or more employees just for lifting and positioning the shims. It becomes evident that while shims may vary the gap between die members, shims do not provide a quick, inexpensive and simple way of adjusting the die members.

In attempts to eliminate the above disadvantages, some presses have been fitted with elaborate carriage mechanisms for moving the die members. However, because such carriage mechanisms are often complex in nature, they are costly and subject to mechanical breakdowns. That they have not fully met existing needs is evidenced by the continuing widespread use of the cumbersome box and shim arrangements described above.

When adjustable dies are mounted on (including in) a box-like or other type of frame, it is then usually possible to remove them from the press in order that other types of tooling can be used therein. To provide a means for proper alignment of the frame and dies with the elongated ram of the press during reinstallation of the dies, a keyway is frequently provided in the press bed beneath the ram, in which is received a key or keys of corresponding width keyed into or integral with the die set on the centerline of the underside of the frame. Past experience with removeable frame die sets has disclosed a harmful tendency for the ram to cock toward one side or another as it presses down on the workpiece. In the course of an extended search for the difficulty it was learned, surprisingly, that in the present state of the art of manufacturing large capacity presses it is extremely difficult to achieve accurate alignment of such keyways with the plane in which the longitudinal axis of the ram face moves up and down in the press. Accurate alignment has not been achieved in relatively large numbers of the presses in use today. Thus, in such presses, an adjustable die set which is accurately aligned with the bed keyway will be off-center relative to the ram. In such circumstances the ram will contact the work off-center, and as the work bends it will exert side-wise forces on the ram which cause the cocking action referred to above.

As will become apparent from a reading of the following description and claims, the present invention provides a uniquely constructed adjustable die assembly which overcomes known problems confronting prior art assemblies as discussed hereabove. In particular, the present invention provides a pair of die members capable of being quickly and accurately adjusted relative to the press ram and to one another without the need for any cumbersome shims or costly carriage mechanisms or the like, while resisting force components generated in presses having capacities of up to 500 tons and higher.

DESCRIPTION OF THE INVENTION

The present invention relates to an improved adjustable die assembly for use in a press of the type having a ram member arranged for up and down movement toward and away from a bed portion of said press. The invention includes a frame portion which may be mounted on or constitutes the bed portion of the press, and a pair of die members supported on an upwardly facing surface of the frame portion. The die members may extend substantially parallel to one another for bending angles or making cylindrical sections, or may be arranged along intersecting lines at one or more angles to one another for bending conical sections. Normally the dies are positioned on opposite sides of the line of travel of the ram, which usually is mounted for reciprocating motion down and up from above the dies. Each die member includes an upward portion extending away from the frame surface and a support portion resting on the frame surface and attached to the upward portion.

In a preferred embodiment, the upward and support portions of each die member have a substantially L-shaped cross-sectional configuration, with the upward portions extending upright and the supporting portions extending away from each other on the frame surface.

Certain aspects of the invention include the use of any effective clamping means for temporarily but fixedly securing the dies to the frame member with or without the aid of certain preferred groove arrangements. In those aspects of the invention which include clamping means, the latter preferably includes one or more grooves (including slots ) in the upwardly facing surface of the frame member, which define and are aligned with the path traversed by the dies during their adjustment and which extend at one or more angles to the longitudinal axes of the dies. The grooves may extend along straight or curved lines, depending on whether it is desired to adjust the dies to a variety of parallel or angularly related positions, but in either case it is preferred that the angle between the aforementioned lines and the longitudinal axes of the dies (viewed perpendicular to the surface on which the dies move during their adjustment) should be more than 45°, e.g. the longitudinal axes of the dies and those portions of the grooves which are nearest such axes (viewed perpendicular to the above-mentioned surfaces) should be more nearly perpendicular than parallel to one another.

Each die extends across at least one such groove. Each die may have its own groove or grooves, or may share a groove or grooves with another die. Preferably, in die sets with longitudinally elongated forming surfaces, in which the present invention provides particular advantages, each die may extend across two or more of such grooves, at longitudinally distributed positions along the length of the die.

The clamping means also includes support blocks. Each of the aforementioned grooves slideably receives at least one support block having at least one, are preferably a plurality of separate threaded apertures extending upwardly therethrough. Each die member is likewise provided with one or more corresponding apertures extending through it which are alignable with the apertures formed through one of the support blocks. Fasteners such as high tensile strength bolts extend through the apertures in the die members and are selectively threaded into the aligned apertures in the support block in order to draw the support blocks into tight clamping engagement with the frame, in a manner to be described in greater detail below, whereby the clamping action between the die members and respective support blocks resists the spreading forces which act on the die members during the pressing operation, thereby inhibiting rocking motion of the die members.

The groove(s) may be any kind of groove (including slots extending all the way through the frame) having parallel or non-parallel sides, but preferably having narrower and wider portions respectively nearer and farther from the upward facing surface of the frame for holding a slidable support block of compatible size and shape captive in the groove. It is preferred that the device includes in the wider portion of the groove (where such is present) or elsewhere in the frame, an under-surface or surfaces, accessible in or through the groove, against which such blocks may be clamped. The groove and support blocks may be of similar or dissimilar but compatible cross-section and size, but are preferably of the same size and shape, and engage one another over a sufficient portion of such under-surface(s) for temporarily but fixedly securing the dies in place in opposition to the spreading forces exerted on the dies during bending of a workpiece. Preferably the undersurfaces are substantially parallel to the upward surface(s) of the frame on which the dies are supported.

In a particularly preferred embodiment, there is in the frame portion of the device a plurality of separate grooves spaced from the preferably extending substantially parallel to one another, with each of the grooves extending perpendicular to the longitudinal axes of the pair of die members. In said particularly preferred embodiment, each of the grooves has a cross-section of substantially inverted T-shaped configuration, holds captive a pair of support blocks each having a cross-sectional configuration compatible with that of the groove and spans substantially the entire. width of the frame surface.

Die sets constructed in accordance with the invention preferably should, but need not necessarily, include positioning means for establishing and maintaining the slideable dies in any one of a predetermined number of positions on the frame member while the dies are in an unclamped condition. Such positioning means, when employed, may take any suitable form but preferably includes arrays of a plurality of positioning apertures, corresponding to said predetermined die positions, extending through the upwardly facing surface(s) of the frame member within the area of said surface traversed by the dies during adjustment thereof. By means of one or more registry openings extending through the dies, preferably in the support portions thereof, and alignable with said positioning apertures, and by means of positioning pins adapted for insertion into, and withdrawal from, both said positioning apertures and registry openings, the unclamped dies may be positioned with accuracy and precision in said predetermined positions. Alternately, but less preferably, the arrays of positioning apertures may extend through the lower surfaces of the dies while the registry opening or openings may extend through the frame. The positioning pins, positioning apertures and registry openings may all have similar or dissimilar cross-sectional sizes and shapes, provided the size(s) and shape(s) of the pins or individual portions thereof are compatible with the apertures and openings. Preferably the apertures and openings are of the same diameter, and the pins are of substantially the same diameter in order that when the pins are in place the dies will be virtually immobilized against motion toward and away from the plane of movement of the ram. But, it is particularly preferred that the apertures, openings and pins as above described be used in combination with clamping means which are capable of being clamped with sufficient holding power to minimize any tendency for the dies to roll outwardly relative to the ram during work-forming.

Another feature which may, but need not necessarily, be employed in the invention, is a self-lifting means for the dies including a plurality of support members which: are moveable upwardly and downwardly independently of the lower surfaces of the dies; are distributed about such lower surfaces at a sufficient plurality of spaced positions for at least partially supporting the dies relative to the frame upward surface; and have an aggregate area of contact between themselves and said upward surface which is relatively small (e.g. less than 20%, preferably less than 5% or 2%) compared to the total area of contact between the dies and said upward surface when the dies are in a clamped condition. The surfaces of the support members which contact the frame upward surface may be of any convenient shape, including flat, but spherical surfaces with a low coefficient of friction relative to the frame upward surface are preferred. The self-lifting means includes force means which continuously or intermittently bear, directly or indirectly, downwardly against said support members and upwardly against the dies for appreciably reducing frictional contact between the die members and the frame upward surface. The force means may or may not move the die members an appreciable distance from the frame upward surface. A variety of mechanical, electromechanical, hydraulic and pneumatic force means may be employed, but resilient biasing means such as springs are preferred. According to a particularly preferred embodiment each die member may include a plurality of recesses extending away from the confronting frame surface, with a separate, large ball bearing positioned within each recess and and biased toward the confronting frame surface by resilient biasing means arranged in each recess. After the fastening bolts threadedly connecting the die members to their support blocks are removed, the biasing means exerts a downward force against the ball bearings and an upward force against the dies which appreciably reduces frictional contact between the dies and the frame, allowing the die members to skid or roll across the frame on the bearing assemblies. It is, of course, understood that the bearing assemblies may be eliminated, with each die member being directly slid across the abutting frame surface after withdrawal of the appropriate fastening bolts and positioning pins, respectively.

In certain circumstances, such as for example when it is acceptable or convenient to dedicate a press to the kind of bending work normally performed on a press brake, the above-mentioned frame of the die set may itself constitute the bed of the press, and the above-mentioned grooves may then be formed in the press bed. Alternatively, the frame could be welded or otherwise permanently fastened to the press bed. However, in many applications of the invention, it will be desired to have the frame and dies removable from the press so that other tooling can be used in the press; and in such circumstances the frame may be separate from the bed. For example, the frame portion of the present invention may include a heavy plate directly mounted on the bed portion of the press, with the grooves being formed in the plate as discussed hereinabove. In order to position the plate on the bed, the plate may be provided along the centerline or other reference line along its lower surface, with a key which is adjustable laterally, and which may in connection with such lateral adjustment also move longitudinally. Such key is positioned to engage a correspondingly positioned keyway in the press bed for centering the die set with the dies being located on opposite sides of the plane in which the press ram moves. In a preferred embodiment, upwardly extending key wall means are positioned on the underside of the frame. Such wall means, viewed perpendicular to the under surface of the frame, converges at an oblique angle, preferably less than 45°, or more preferably less than 25° or 15°, with the frame centerline or other reference line which represents a centerline between the dies. Said key wall means, viewed from the same position indicated above, is superimposed upon and extends at least partly across a corresponding keyway formed in the press bed. Because the key wall means is in communication with the space within the keyway, a key of sufficient height, situated in the keyway, can contact both the oblique key wall means and the sides of the keyway. Through an actuator secured to the frame in contact with the key, the latter can be caused to move in the keyway in either or preferably in both longitudinal directions. For example, the actuator may be a screw threadedly engaging a correspondingly threaded portion of the frame with one end of the screw against the key, or secured to the key in a manner which permits relative rotation, the other end of the screw being accessible for application of rotational force for turning the screw. Rotation of the screw advances or retracts the key through a variety of longitudinal positions corresponding to varying lateral positions of the frame, to which the frame can be adjusted by turning of the screw. Assemblies of the foregoing type may be referred to as "adjustable keys," and such keys may be employed in pairs with one towards each end of the die set to afford opportunity for lateral adjustment of the die at both ends. The various parts of the adjustable key described above as being mounted or positioned on the bed may alternatively be mounted on the frame and vice versa, although the previously described arrangement with the key carried by the frame is preferred. After the desired adjustment has been made, a locking member can be pressed against the key to prevent further movement. Even though the keyway in the bed portion of a given press may be laterally misaligned relative to the press ram, the adjustable key assembly of the present invention makes it possible to precisely align the frame portion and ultimately the die members supported thereon relative to the plane in which the ram moves.

For purposes of explanation only, the present invention is illustrated in conjunction with a press brake assembly. However, the present invention is not to be limited to use with only a press brake assembly; rather, the present invention is equally adaptable for use with almost any type of machine assembly which employs a reciprocating work member designed for engaging a workpiece mounted on a pair of die members. In addition, the die members are not considered to be limited to use with plate-shaped workpieces; rather, the die members are believed to be of use in supporting workpieces of almost any configuration.

BRIEF DESCRIPTION OF THE DRAWINGS

A preferred embodiment of the present invention will now be described in greater detail in the following portions of the specification when taken in conjunction with the attached drawings in which like reference characters identify identical apparatus, and in which:

FIG. 3 is a schematic end view of the die members of FIG. 1;

FIG. 4 is a view taken along the section A—A in FIG. 2;

FIG. 5 is a view taken along the section B—B in FIG. 2;

FIG. 6 is a view taken along the section C—C in FIG. 2;

FIG. 7 is a view taken along the section D—D in FIG. 2;

FIG. 9 is a schematic end view of an alternative embodiment of the present invention.

DETAILED DESCRIPTION OF THE PREFERRED EMBODIMENT

Figure 2:
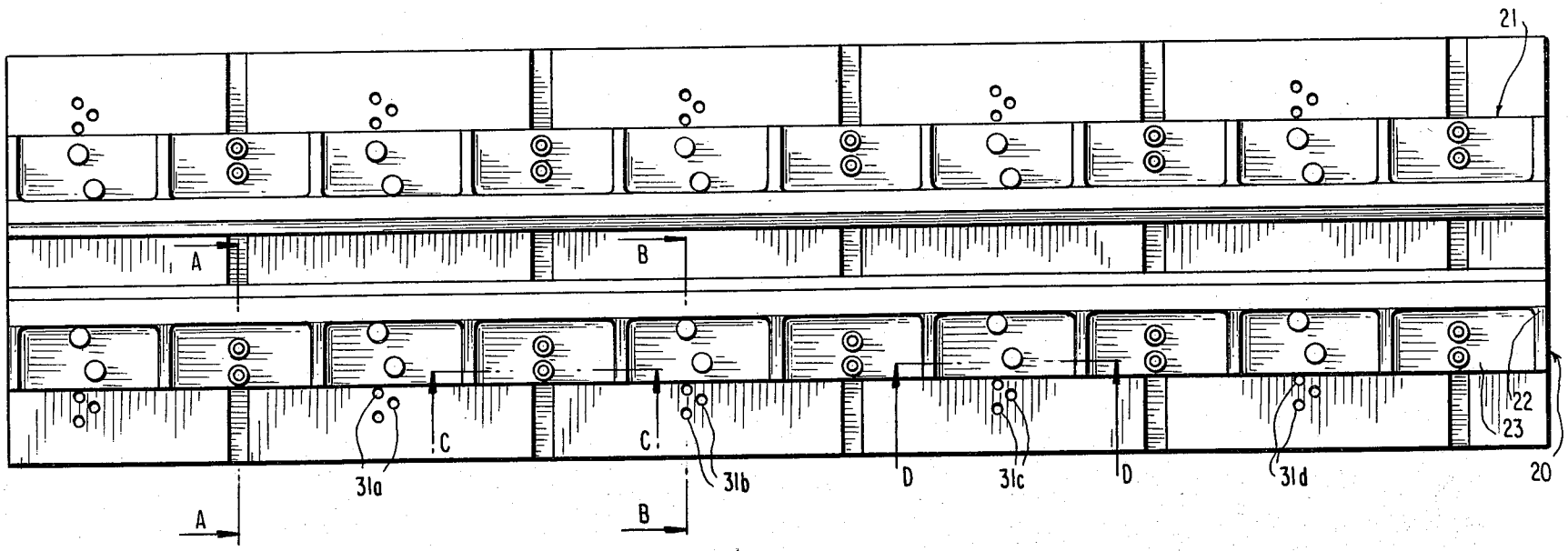
FIG. 2 is a schematic representation of a top view of the embodiment according to FIG. 1.

With reference to FIGS. 1–8, a preferred embodiment of the present invention will now be described in detail. As shown in FIG. 3, a press brake assembly is generally indicated by the numeral 10 and, includes a ram 11 arranged for conventional, reciprocating movement toward and away from a fixed bed 12 of the press brake assembly 10. Because the support structure of the press assembly is itself conventional in nature, it has not been shown for reasons of simplicity. Reciprocating ram 11 may be selectively powered by any conventional power source such as hydraulic, magnetic or even manual power. A conventional press brake assembly having such reciprocating ram is suggested in U.S. Pat. No. 2,451,302 issued Oct. 12, 1948 to Peters and incorporated by reference thereto.

Referring again to FIG. 3, the fixed bed 12 supports a frame portion of the present invention which includes a steel plate or platen 13 and a pair of generally gusset-shaped side supports 14*a* and 14*b*. Each of the side supports 14*a* and 14*b* extends between fixed bed 12, and a bottom surface of plate 13. In the preferred embodiment shown in FIG. 3, plate 13 is permanently attached to side supports 14*a* and 14*b* by a conventional fastening such as weldings 16 or the like, with a portion of fixed bed 12 also directly supporting plate 13 along a common contact surface 17.

A pair of adjustable die members 20 and 21 are slidably disposed on a substantially planar surface of plate 13 facing toward reciprocating ram 11. During operation, a workpiece WP of sheet metal or the like is placed across die members 20 and 21 prior to actuation of reciprocating ram 11. Upon actuation of ram 11, a curved male end portion 35 of ram 11 is caused to move from a rest position toward fixed bed 12, with the curved end portion 35 eventually contacting workpiece WP. Further movement of ram 11 results in the bending of workpiece WP as shown in FIG. 3. As the die members 20 and 21 are brought closer together, the angle of bend formed between opposite sides of a workpiece WP increases. Likewise, as the die members 20 and 21 are moved further apart from one another, the angle of bend formed between opposite sides of the workpiece WP decreases for any given penetration. By adjusting the spacing between die members 20 and 21, and the depth of penetration of the male end portion 35, it becomes possible to form a variety of different bends in a workpiece WP with a ram employing a single curved end portion and a single pair of die members. As can be well understood, if the shape of curved end portion 35 of ram 11 is changed, bends of additional size can be formed in workpiece WP as needed. Regardless of the particular shape of the curved end portion, accurate positioning of die members 20 and 21 and accurate selection of penetrating depth provide a manner for directly controlling the angle or bend formed in a workpiece WP. As will become clear hereafter, the present invention provides a simple structure for quickly and accurately positioning die members 20 and 21 relative to one another, while at the same time retaining the die members in their proper positions on plate 13 as ram 11 deforms workpiece WP.

Figure 1:
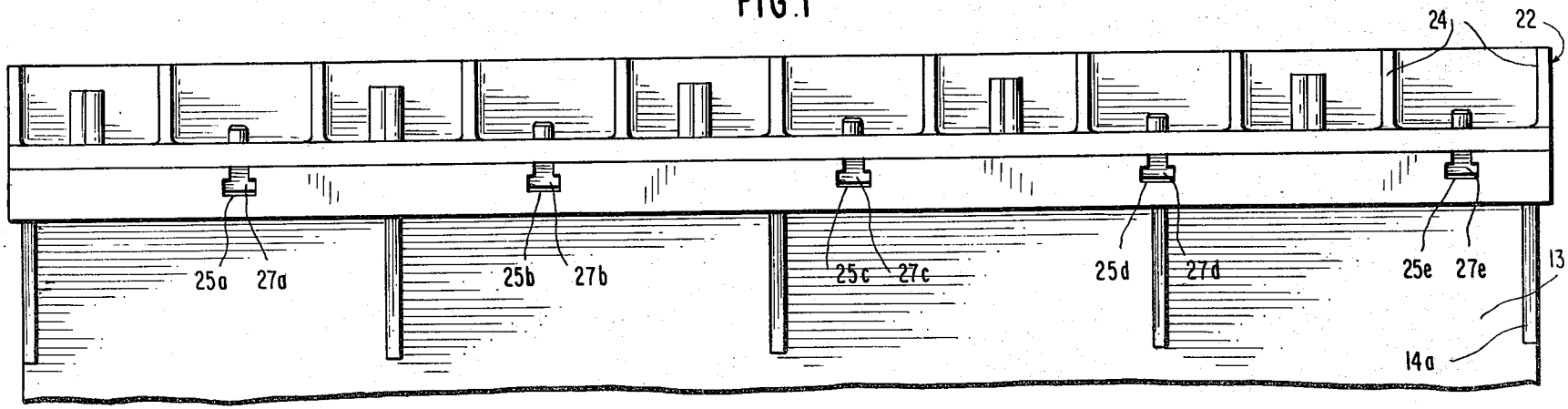
FIG. 1 is a schematic representation of a side view of a press assembly employing die members formed in accordance with a preferred embodiment of the present invention.

Turning now to FIGS. 1 and 2, the unique manner in which the die members are adjustably supported on plate 13 will now be explained in detail. Because the facing die members 20 and 21 are of similar construction, a discussion of one of the die members is believed to be sufficient to provide a proper understanding of both die members. As shown in FIGS. 1 and 2, die member 20 has an elongated configuration including an upright portion 22 and an attached, support portion 23 which rests on plate 13. The upright and support portions form a substantially L-shaped configuration. To provide additional strength to die member 20, a plurality of substantially triangularly-shaped gussets 24 extend parallel to one another between portions 22 and 23. Gussets 24 are integrally attached to portions 22 and 23 and provide support for resisting forces transmitted from ram 11 through the workpiece WP and into die members 20 and 21. It is noted in FIG. 3 that the support portions 23 of the die members 20 and 21 extend substantially away from each other as well as away from the projected line of travel of reciprocating ram 11.

A plurality of separate groove assemblies 25*a–e* are each formed across plate 13 in a direction extending substantially transversely to the longitudinal axis of plate 13 and die members 20 and 21, respectively. In a preferred embodiment, the grooves 25*a–e* extend substantially parallel to one another across the entire width of plate 13. The number of grooves 25*a–e* shown in FIGS. 1 and 2 is in no way considered to limit the number of grooves actually employed, but as been illustrated for purposes of explanation only. The actual number of grooves is entirely dependent on a number of factors such as the size of plate 13, the size of die members 20 and 21 and the capacity of the press brake assembly. Furthermore, as best shown in FIGS. 1 and 6, each groove 25 is formed with a pair of undercut portions 26*a* and 26*b* which extend transversely into portions of plate 13 spaced from the surface of plate 13 contacting die members 20 and 21, thereby forming a substantially inverted T-shaped configuration. Each groove 25*a–e* serves as a track for maintaining the proper longitudinal positioning of the die members relative to one another as well as maintaining the die members in contact with plate 13 as will be explained. While each groove 25*a–e* is shown to extend completely across plate 13, it is considered within the scope of the present invention to have some or all of the grooves 25*a–e* extend only part way across plate 13. It is also not necessary that grooves 25*a–e* extend from opposite sides into alignment with one another, rather, it is only necessary that a plurality of grooves extend from opposite sides of plate 13 toward the line of travel of ram 11 in order to allow die members 20 and 21 to move toward and away from one another.

As shown in FIG. 6, a support block 27*b* is slidably mounted within a groove 25*b*, with block 27*b* having an inverted T configuration substantially similar to the inverted configuration of groove 25*b*. In a similar manner each of the grooves 25*a–e* also receives and supports a separate block 27*a–e*. In a preferred embodiment, each block 27*a–e* has an inverted T configuration similar in shape to the configuration of a respective groove 25*a–e*. Each block 27*a–e* is relatively short, having a length substantially similar to the length of the portion of gusset 24 contacting portion 23 of the die members, as best shown in FIG. 4.

It is further noted that each block 27a–e has an end surface extending substantially flush with an adjacent end surface of either member 20 or 21. Each support block 27a–e is formed with at least one, and preferably two threaded apertures 28a and 28b extending away from die members 20 and 21. In a like manner, each die member 20 and 21 includes a plurality of pairs of apertures 29a and 29b which are positioned such that when aperture 29a is aligned with block aperture 28a, aperture 29b will be aligned with block aperture 29b. During assembly, each of the blocks 27a–e is inserted in a separate groove 25a–e and is positioned such that apertures 28a and 28b are aligned with respective apertures 29a and 29b. A plurality of high tensile strength, threaded fastening bolts 30 are then inserted through apertures 29a and 29b, with end portions of the bolts 30 projecting into respectively aligned apertures 28a and 28b.

As the bolts 30 are rotated in the appropriate direction, the threads formed on bolts 30 engage the threads formed in apertures 28a and 28b and draw the bolts 30 further into the blocks 27a–e. When further rotation of bolts 30 is attempted, the blocks 27a–e are drawn toward die members 20 and 21, until portions of each block 27a–e engage the transverse portions 26a and 26b of a respective groove 25a–e, preventing further movement of the block. At this time, the block 27 and the adjacent portion of the die member 20 are clamped into tight contact with plate 13 via bolts 30. The tight contact between blocks 27a–e and plate 13 resist sliding movement of the blocks within the grooves 25. More importantly, the interaction between blocks 27 and the transverse portions 26a and 26b of grooves 25 prevents the attached die members from being lifted away from plate 13, even when subjected to lifting or rocking forces transmitted from ram 11 through workpiece WP.

In order to properly align the die members 20 and 21 relative to one another, a plurality of pairs of positioning apertures 32a and 32b are formed through alternating portions 23 defined by adjacent gussets 24. Each pair of positioning apertures is of identical configuration and is spaced an equal distance from an edge of each die member. In particular, each pair of positioning apertures 32a and 32b is preferably staggered with respect to gussets 24 located on opposite sides thereof. Furthermore, each pair of apertures 32a and 32b extends completely through portion 23 for a purpose which will become clear.

As shown in FIG. 2, plate 13 is formed with a plurality of spaced groups of apertures 31a–e with the groups of apertures having similar configurations and being equally spaced from the same edge of plate 13 as the positioning apertures 32a and 32b. Furthermore, each group of apertures 31a–e includes a plurality of apertures staggered relative to grooves 25 located on either side. The groups of apertures 31a–e are arranged so as to align with the positioning apertures 32a and 32b when the die member is uniformly spaced from the edge of plate 13. Because each die member includes positioning apertures 32a and 32b which are alignable with apertures in the various groups of apertures 31a–e, it becomes possible to quickly and easily align the positions of the die members 20 and 21 by merely aligning each pair of apertures 32a and 32b with corresponding apertures in the groups of apertures 31a–e. Because the groups of apertures 31a–e and the positioning apertures 32a and 32b are each staggered, it becomes possible to move die members 20 and 21 relatively small distances toward and away from one another and still align corresponding openings with one another.

A separate positioning pin 33 is inserted through each of the openings 32a and 32b, with a portion of the pin 33 entering one of the openings 31a–e. Pins 33 prevent the die members 20 and 21 from sliding out of their properly aligned positions even when ram 11 deforms workpiece WP. Because the forces generated during the actual bending operation are substantially absorbed by the blocks 27a–e and pins 33, the more expensive bolts 30 are not directly subjected to the shear forces sufficient for causing premature failure of such bolts. In addition, pins 33 serve to ensure quick, and yet precise alignment of the die members 20 and 21 relative to one another. As shown in FIG. 5, each of the locating pins 33 has an enlarged end portion 34 which is knurled to allow for easy insertion and removal from the aligned apertures. While the particular arrangement of positioning apertures 32a and 32b and groups of apertures 31a–e shown in FIG. 2 is preferred, it is considered within the scope of the present invention to employ various configurations of the groups of apertures 31a–e as well as corresponding configurations of the positioning apertures 32a and 32b so as to provide alignment therebetween when the die members are uniformly spaced from one another.

Figure 8:
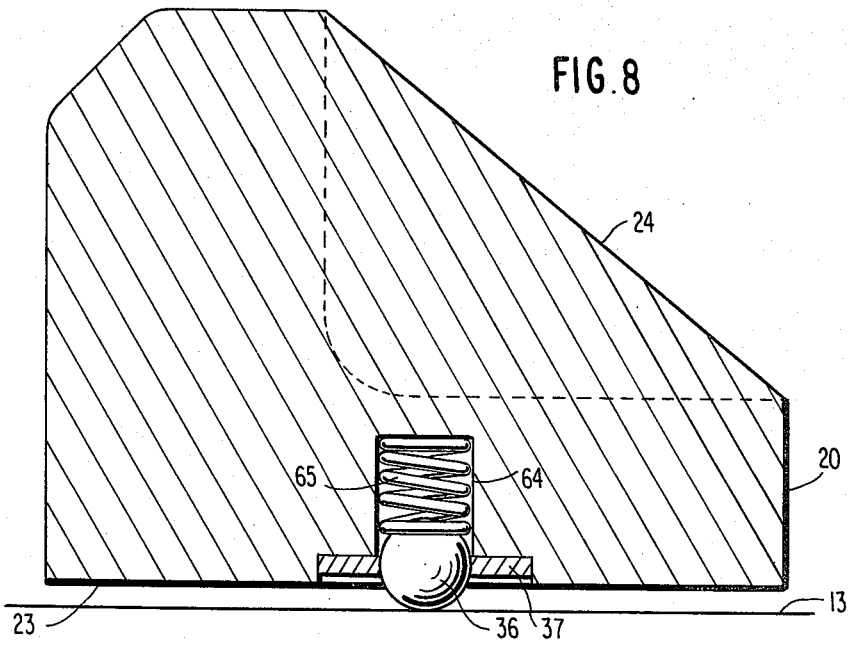
FIG. 8 is a view of a cross-sectional portion of a die member showing a bearing assembly for moving the die member.

A bearing assembly for slidably supporting the die members 20 and 21 is shown in FIG. 8, wherein only the die member 20 is shown for purposes of simplicity. However it is to be understood that the bearing assembly is equally applicable with each die member. Likewise, while only one gusset 24 has been shown for purposes of explanation, it is to be understood that a separate bearing assembly can be mounted beneath any member, or all of the gussets 24 as necessary for supporting the weight of a particular die member. A recess 64 extends into support portion 23 of die member 20 away from a surface confronting plate 13. Positioned within recess 64 is a helical spring biasing member 65 which has a first end abutting an end of recess 64. A spherical ball bearing member 36 is also retained within recess 64 and contacts a second end of spring 65. A ring-shaped retaining member 37 is positioned about an inlet formed in a bottom surface of support portion 23. The ring-shaped retaining member has an inner diameter less than one half the spherical radius of ball bearing 36 to prevent the ball bearing from completely separating from recess 64.

Following withdrawal of fastening bolts 30, the plurality of separate biasing springs 65 exert a downward force against ball bearings 36 and an upward force against die members 20 and 21 sufficient to appreciably reduce the frictional contact between dies 20 and 21 and plate 13, allowing the dies to be easily moved across plate 13 on their respective bearing assemblies. It is noted that the biasing springs 65 may or may not move the dies 20 and 21 an appreciable distance from plate 13.

After the die members 20 and 21 are properly positioned relative to one another, the positioning pins 33 are reinserted through newly aligned openings 31 and 32 to prevent accidental movement of the die members. Fastening bolts 30 are then reinserted into newly aligned apertures 28 and 29 to draw the raised lower surface portions of the die members 20 and 21 into contact with plate 13. As the raised portions approach plate 13, the biasing springs 65 are forced to contract, with the bearing members 36 moving into their respective recesses 64.

The bearing assemblies may take any convenient shape or may be eliminated altogether, with the die members 20 and 21 being slid directly across plate 13 as required.

Figure 10A:
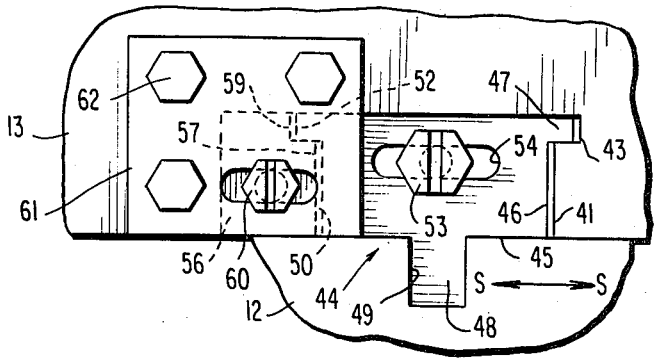
FIGS. 10*a* and 10*b* are end and top views of the adjustable keyway assembly employed in embodiment of FIG. 9.
Figure 10B:
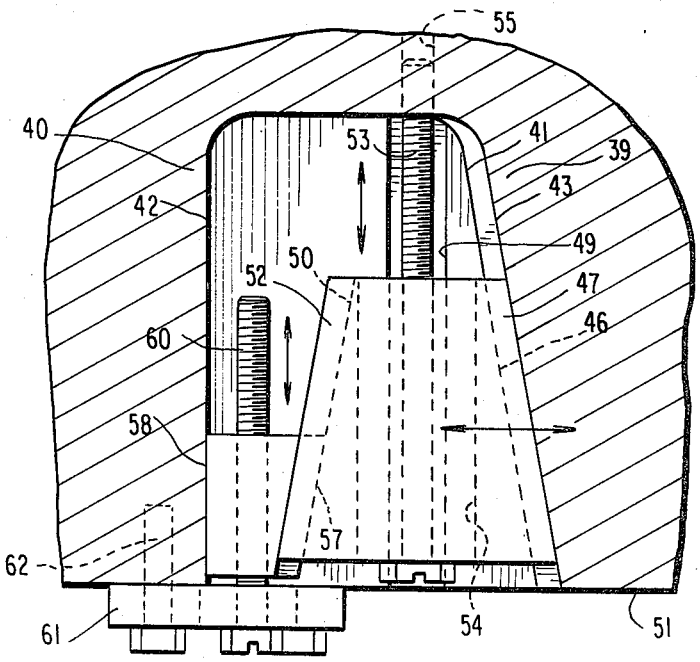

Turning now to FIGS. 9, 10*a* and 10*b*, an alternative structure is shown for fixedly positioning plate 13 on bed portion 12 of the press brake assembly. It has been observed that regardless of the precision craftsmanship employed in the manufacture of the press brake assembly, there is a tendency for the bed portion 12 to be slightly misaligned in the horizontal plane with respect to the reciprocating ram 11. As a result, if the plate 13 of the present invention is aligned only with bed portion 12 in a conventional manner, plate 13 will also be slightly misaligned with respect to ram 11. In order to ensure proper alignment between ram 11 and plate 13 for a specific press brake assembly, a uniquely structured adjustable key assembly 40 is employed as will be explained hereafter.

A pair of adjustable key assemblies 40 are mounted at opposite longitudinal ends of plate 13, however, for purposes of explanation, only one of the adjustable key assemblies 40 is shown in FIGS. 9 and 10. The adjustable key assembly includes a keyway 39 extending into a surface portion of plate 13 which contacts bed portion 12. Keyway 39 includes a first side wall 41 which is tapered toward a second side wall 42 which extends substantially parallel to a longitudinal axis of plate 13. In other words, the distance between walls 42 and 41 uniformly decreases as the distance from the end 51 of plate 13 increases. Each of the side walls 42 and 41 preferably extends in a perpendicular direction away from bed 12. In addition, side wall 41 further includes an indirect recess portion 43 extending in a direction substantially parallel to the bottom surface of plate 13, with side wall 41 having a substantially reverse L-shaped configuration. Slidably mounted within keyway 39 is a key member generally designated 44. Key member 44 includes a body portion 45 having a tapered side 46 similar in shape and contacting side wall 41 of keyway 39. In addition, the tapered side 46 of key 44 also includes a flange portion 47 which extends into recess portion 43 of keyway 39, preventing key member 44 from separating from its respective keyway. Key member 44 further includes a substantially rectangularly-shaped flange portion 48 extending outwardly from body portion 45 toward bed portion 12. In a like manner, bed portion 12 is also formed with a longitudinally extending groove 49 of matching shape to flange portion 48. During assembly, key member 44 is inserted into keyway 39, with flange portion 48 extending into the groove 49 formed in bed portion 12.

Referring to FIG. 10*b*, it is noted that key 44 includes a further tapered side 50, with sides 46 and 50 being tapered toward one another as the distance from the end portion 51 of plate 13 increases. Tapered side 50 also extends in a substantially perpendicular direction away from bed 12 and is formed with an undercut recess portion 52 extending in an opposite direction from recess portion 47. A threaded bolt 53 extends through a longitudinally extending, threaded aperture 54 formed through key 44, with the threaded bolt 53 extending into an aligned opening 55 formed in plate 13.

A wedge-shaped locking member 56 is also positioned within keyway 39, with locking member 56 having a first side 57 similar in shape to tapered side 50. Locking member 56 includes a second side 58 which is similar in shape to side 42 and is positioned so as to contact side 42 when the locking member 56 is adjacent to end portion 51 of plate 13. In addition, side 57 includes a recess 59 which receives the flange portion 52 of key member 44. Finally, a threaded bolt 60 extends completely through a threaded aperture formed in locking member 56, with bolt 60 extending substantially parallel to bolt 53. A face plate 61 of substantially rectangular configuration overlaps the end of locking member 56 as well as the end of key member 44, with face plate 61 attached to plate 13 via a plurality of conventional fastening bolts 62. An opening is formed through plate 61 to allow for rotation of bolt 60 into the opening formed in locking member 56.

To adjust the position of plate 13 in the horizontal direction relative to bed portion 12, it is merely necessary to rotate bolt 53. This causes key member 44 to move within keyway 39, with flange portion 48 also moving within the recess 49 formed in bed portion 12. Because of contact between the tapered side wall 41 of keyway 39 and the tapered side 46 of key 44, advancement of key 44 into the keyway results in sideways movement of plate 13 as shown by the arrows SS in FIG. 10*a*. This is the only possible result due to the inability of key 44 to move sideways because of the engagement of flange portion 48 with the groove 49 of bed 12. It now becomes possible to quickly and easily align plate 13 with ram 11, by merely adjusting the positions of each of the keys 44 positioned at opposite ends of plate 13. Once plate 13 is properly positioned, bolt 60 is rotated to bring locking member 56 into tight engagement with key 44, preventing further advancement of the key within its keyway. Because a specific plate 13 usually needs to be aligned only once for a particular press brake, the key member 44 can be quickly adjusted and then locked in place via locking member 56.

It is to be understood that the plate member of the present invention can be permanentally attached to bed portion 12 by welding as shown in FIG. 3, with the adjustable key assembly being eliminated. However, because of the inherent misalignment existing between most ram and bed portions of conventional press brake assemblies, a pair of adjustable key assemblies makes it quick and easy to align the plate for any particular press brake.

The present invention is not to be limited to the embodiment disclosed hereabove, rather, the scope of protection for the present invention is only to be limited by the claims following hereafter.

What is claimed is:

1. An assembly for precisely positioning a pair of die members on the bed of a press beneath a ram mounted for movement toward and away from said bed, said assembly comprising:

a frame member having an upwardly facing surface for supporting said die members;

clamping means extending between each of said die members and said frame member for selectively clamping and unclamping each of said die members with respect to said upwardly facing surface; and self-lifting means on said die members for lifting said die members, when unclamped, out of contact with said upwardly facing surface.

2. An assembly for precisely positioning a pair of die members on the bed of a press beneath a ram mounted for movement toward and away from the bed, said assembly comprising:

a frame member having an upwardly facing surface for supporting said die members;

clamping means extending between each of said die members and said frame members for selectively clamping and unclamping each of said die members with respect to said upwardly facing surface;

positioning means, independently operable of said clamping means, extending between the die members and preselected locations on said upwardly facing surface of said frame member for accurately positioning the die members relative to one another on said frame member; and self-lifting means on said die members for lifting said die members, when unclamped, out of contact with said upwardly facing surface.

3. An assembly according to claims 1 or 2, wherein, said self-lifting means comprises a plurality of support members moveable upwardly and downwardly independently of the lower surfaces of the die members and spaced about such lower die surfaces for selectively supporting at least a portion of each die member relative to the frame upward surface; said self-lifting means further comprising force means which bear downwardly against said support members and upwardly against the die members for appreciably reducing frictional contact between the die members and the frame member upon withdrawal of said clamping means.

4. An assembly according to claim 3, wherein said support members have spherical surfaces for contacting the upward surface of the frame.

5. An assembly according to claim 3, wherein said force means comprises a resilient member.

6. An assembly according to claim 3 wherein said force means comprises an elongated helical spring member.

7. An assembly according to claim 3, wherein said support members are mounted for reciprocal movement in separate elongated openings extending in vertically upward directions through said die members, with lower end portions of said openings extending through the lower surfaces of said dies.

8. An assembly according to claims 1 or 2, wherein said clamping means comprises groove means extending through the upwardly facing surface of said frame members and disposed more nearly perpendicular than parallel to longitudinal axes of said die members, said groove means including at least one under-surface portion spaced from and extending substantially parallel to said upwardly facing surface of said frame member.

9. An assembly according to claim 8, wherein said clamping means further comprises a plurality of separate support blocks slidably received in said groove means, said support blocks each having a surface portion of cross-section and size for engaging a sufficient portion of said groove under surface so as to prevent withdrawal of said support blocks from said groove means in the direction of said upwardly facing surface.

10. An assembly according to claim 9, wherein said groove means comprises a plurality of separate grooves extending substantially parallel to and spaced from one another, each groove having at least one end portion extending through one of two opposed side walls of said frame member and each groove having a substantially inverted T cross-sectional configuration.

11. An assembly according to claim 10, wherein at least one support block is positioned in each of said separate grooves, with each support block having a substantially inverted T cross-sectional configuration substantially similar in size to a surrounding groove.

12. An assembly according to claim 9, wherein said clamping means further comprises a pair of threaded apertures extending through each of said support blocks alignable with corresponding openings extending through either of said die members, and a separate threaded bolt extending through each pair of aligned openings for drawing said support block and die member into clamping engagement with said frame member.

13. An assembly for precisely positioning a pair of die members on the bed of a press beneath a ram mounted for movement toward and away from said bed, said bed having a groove therein for establishing a reference position in said bed relative to the plane in which the longitudinal axis of the ram moves, said assembly comprising:

a frame member having a lower facing surface and an upwardly facing surface;

a keyway in said frame;

clamping means extending between each of said die members and said frame member for selectively clamping and unclamping each of said die members with respect to said upwardly facing surface; and adjustable key means positioned on said frame at said lower surface for engaging said groove and keyway and adjusting said frame to compensate for failure of the centerline of the die members to correspond with the plane in which the longitudinal axis of the ram moves.

14. An assembly according to claim 13 including positioning means for said dies, comprising:

an array of positioning apertures each extending through the upward surface of said frame member at predetermined positions corresponding to various desired die positions; at least one registry opening extending through each of said die members and alignable with said positioning apertures; and positioning pin means insertable through and withdrawable from said positioning apertures and registry openings for accurately positioning said die members relative to one another on said frame member.

15. An assembly according to claim 13 wherein said adjustable key means comprises:

upwardly extending key wall means positioned on said frame at said lower surface, said key wall means, viewed perpendicular to said lower surface, extending at an oblique angle relative to the frame centerline or other reference line which extends between and equidistant of the dies, said key wall means being in communication with the space within said keyway and groove; a key carried by said frame of sufficient height, when situated in the keyway, to contact both said oblique key wall means and the sides of the keyway; and an actuator secured to the frame in contact with the key for causing said key to move longitudinally in the keyway, whereby the lateral position of the frame can be adjusted to compensate for failure of the centerline of the dies to correspond with the plane in which the longitudinal axis of the ram moves.

16. An assembly according to claim 15, wherein said actuator comprises an elongated screw threadedly engaging a correspondingly threaded portion of the frame and extending through a threaded aperture formed in said key, whereby selective rotation of said screw advances or retracts the key through a variety of longitudinal positions corresponding to varying lateral positions of the frame.

17. An assembly according to claim 14, wherein a plurality of pairs of registry openings extend through each die member, with said pairs of registry openings being spaced from one another in a direction parallel to the longitudinal axis of each die member, respectively, and each pair of registry openings forms a separate imaginary line extending substantially perpendicular to the longitudinal axis of the die member through which said registry openings extend.

18. An assembly according to claim 14, wherein said array of positioning apertures comprises separate groups of apertures spaced from one another across the upwardly facing surface of said frame member, each of said groups of apertures forming a strip extending in a direction substantially perpendicular to the longitudinal axis of each of said die members, respectively.

19. An assembly for precisely positioning a pair of die members on the bed of a press beneath a ram mounted for movement toward and away from said bed, said bed having a groove therein for establishing a reference position in said bed relative to the plane in which the longitudinal axis of the ram moves, said assembly comprising:

a frame member having a lower facing surface and an upwardly facing surface, a keyway in said frame;

clamping means extending between each of said die members and said frame member for selectively clamping and unclamping each of said die members with respect to said upwardly facing surface;

self-lifting means providing a downwardly directed force against said frame member and an upwardly directed force against said die members for appreciably reducing frictional contact between the die members and frame member;

positioning means for aligning said die members at predetermined locations on said upwardly facing surface; and adjustable key means positioned on said frame member at a lower facing surface for engaging said keyway and groove and adjusting said frame to compensate for failure of the centerline of the die members to correspond with the plane in which the longitudinal axis of the ram moves.

* * * * *

UNITED STATES PATENT AND TRADEMARK OFFICE

CERTIFICATE OF CORRECTION

PATENT NO. : 4,367,644

DATED : January 11, 1983

INVENTOR(S) : Fred Kramer et al

It is certified that error appears in the above—identified patent and that said Letters Patent is hereby corrected as shown below:

In column 7, line 49, "increases" should read --decreases--;

in line 52, "decreases" should read --increases--.

In the drawings, Sheet 2, Figure 6, the reference numeral 25b should be applied to the groove within which 27b is mounted.

Signed and Sealed this

*Twenty-first* Day of *June 1983*

[SEAL]

*Attest:*

DONALD J. QUIGG

*Attesting Officer*

*Acting Commissioner of Patents and Trademarks*